US008789470B2

(12) United States Patent
Frank

(10) Patent No.: US 8,789,470 B2
(45) Date of Patent: Jul. 29, 2014

(54) SEGMENTING SLUG

(75) Inventor: Ben N. Frank, Worden, IL (US)

(73) Assignee: Olin Corporation, Clayton, MO (US)

( * ) Notice: Subject to any disclaimer, the term of this patent is extended or adjusted under 35 U.S.C. 154(b) by 0 days.

(21) Appl. No.: 13/366,566

(22) Filed: Feb. 6, 2012

(65) Prior Publication Data

US 2012/0199035 A1 Aug. 9, 2012

Related U.S. Application Data

(60) Provisional application No. 61/440,122, filed on Feb. 7, 2011.

(51) Int. Cl.
*F42B 12/34* (2006.01)
*F42B 7/10* (2006.01)

(52) U.S. Cl.
USPC ..... 102/509; 102/506; 102/508

(58) Field of Classification Search
USPC ..... 102/506, 508, 509, 510, 518, 519, 502, 102/503
See application file for complete search history.

(56) References Cited

U.S. PATENT DOCUMENTS

| | | | | | |
|---|---|---|---|---|---|
| 216,974 | A | * | 7/1879 | Rice | 102/506 |
| 2,661,694 | A | * | 12/1953 | Allen et al. | 102/508 |
| 3,045,753 | A | * | 7/1962 | Goodwin | 166/55 |
| 3,138,102 | A | * | 6/1964 | Meyer et al. | 102/509 |
| 3,277,825 | A | * | 10/1966 | Maillard | 102/374 |
| 3,349,711 | A | * | 10/1967 | Darigo et al. | 102/509 |
| 4,777,883 | A | * | 10/1988 | Chevich | 102/503 |
| 4,836,110 | A | | 6/1989 | Burczynski | 102/508 |
| 4,882,822 | A | * | 11/1989 | Burczynski | 86/54 |
| 4,947,755 | A | * | 8/1990 | Burczynski | 102/506 |
| 5,149,913 | A | * | 9/1992 | Arakaki | 102/506 |
| 5,259,320 | A | * | 11/1993 | Brooks | 102/509 |
| 5,801,324 | A | * | 9/1998 | Pickard | 102/510 |
| 5,943,749 | A | * | 8/1999 | Swank | 86/54 |
| 6,148,731 | A | * | 11/2000 | Winter | 102/509 |
| 6,176,186 | B1 | * | 1/2001 | Engel | 102/510 |
| 6,776,101 | B1 | * | 8/2004 | Pickard | 102/509 |
| 2002/0056397 | A1 | * | 5/2002 | Carr et al. | 102/509 |
| 2005/0016411 | A1 | * | 1/2005 | Amick | 102/501 |
| 2005/0183616 | A1 | * | 8/2005 | Eberhart et al. | 102/510 |
| 2008/0017064 | A1 | * | 1/2008 | Kapeles | 102/502 |
| 2008/0314280 | A1 | * | 12/2008 | Martini Filho | 102/510 |

OTHER PUBLICATIONS http://www.polywad.com/quikshok.html.*
www.polywad.com/quikshok.html.*
U.S. Appl. No. 29/384,975, filed Feb. 7, 2011, Frank, Ben N.
U.S. Appl. No. 29/384,973, filed Feb. 7, 2011, Frank, Ben N.
Website—http://www.polywad.com/quikshok.html 4 pages.

* cited by examiner

*Primary Examiner* — Samir Abdosh
*Assistant Examiner* — John D Cooper
(74) *Attorney, Agent, or Firm* — Harness, Dickey & Pierce, P.L.C.

(57) ABSTRACT

A segmenting slug has a body having a generally dome-shaped forward portion, a generally cylindrical rearward portion, and an opening in the rear of the body forming an interior chamber. There are a plurality of generally radially extending notches in the dome-shaped forward portion of the slug, and a longitudinally extending groove in the wall of the interior chamber substantially aligned with each notch.

18 Claims, 6 Drawing Sheets

SEGMENTING SLUG

CROSS-REFERENCE TO RELATED APPLICATIONS

This application claims priority to U.S. Provisional Patent Application Ser. No. 61/440,122 filed Feb. 7, 2011. The entire disclosure of the above application is incorporated herein by reference.

FIELD

The present disclosure relates to slugs and similar projectiles fired from shotgun shells.

BACKGROUND

This section provides background information related to the present disclosure which is not necessarily prior art.

A slug is a heavy projectile, usually made of lead or a lead alloy to provide rifle-like performance for a shotgun. There are several different types of slugs including Brenneke slugs, which are solid projectiles with fins formed on the exterior to reduce contact with the barrel of the gun and thereby, reducing friction and increase velocity. Another type of slug is a Foster slug, which has a deep hollow in the rear end of the slug. The forward end of a Foster slug is usually dome-shaped, while the rearward end is usually cylindrical. The cylindrical section usually has fins separated by the channels to minimize the friction on both the barrel and projectile and allow the slug to safely be swaged down when fired through a choke.

Conventional slugs provide a large, single projectile which can be very disruptive of the target in the localized area around the slug. However, conventional Foster slugs have a tendency to over-penetrate when fired at reduced velocities (1400 fps or less). Pre-slitted slugs, such as the slug disclosed in U.S. Pat. No. 3,138,102 (incorporated in its entirety herein by reference) have been developed. However, in order to prevent the slitted slug from prematurely segmenting, slitted slugs have generally been constructed, such that they only segment at relatively high velocities

SUMMARY

This section provides a general summary of the disclosure, and is not a comprehensive disclosure of its full scope or all of its features.

Generally, embodiments of this invention provide a segmenting slug. The slug preferably comprises a body having a generally dome-shaped forward portion, and a generally cylindrical rearward portion. There is an opening in the rear of the body forming an interior chamber. There are a plurality of generally radially extending notches in the dome-shaped forward portion of the slug. A longitudinally extending groove in the wall of the interior chamber is generally aligned with each radially extending notch.

There is preferably a generally central recess in the forward end of the slug. There are preferably three or four notches, substantially equally spaced around the generally central recess in the forward end of the slug. The notches preferably have a generally v-shaped transverse profile, and the grooves preferably also have a generally v-shaped transverse profile.

In the preferred embodiment, the rear portion of the slug has a plurality of fins formed by a plurality of substantially parallel channels oriented at an angle with respect to the longitudinal direction. The outer ends of the notches a preferably each aligned with one of these channels.

Some embodiments of the slug of this invention maintain their integrity when fired, yet can readily break into segments when striking a target, even at lower velocities. Upon segmentation, the lighter individual pieces penetrate less, reducing the risk that the slug or pieces of the slug penetrate through the intended target with enough energy to cause severe damage to anything beyond the target. Furthermore the segments can cause disruption in the intended target over a greater volume. In some embodiments the slug can segment at close range targets at muzzle velocities as low as 1250 fps. In other embodiments the slug can segment at moderate ranges (e.g., about 40 yards) at muzzle velocities as low as 1400 fps.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
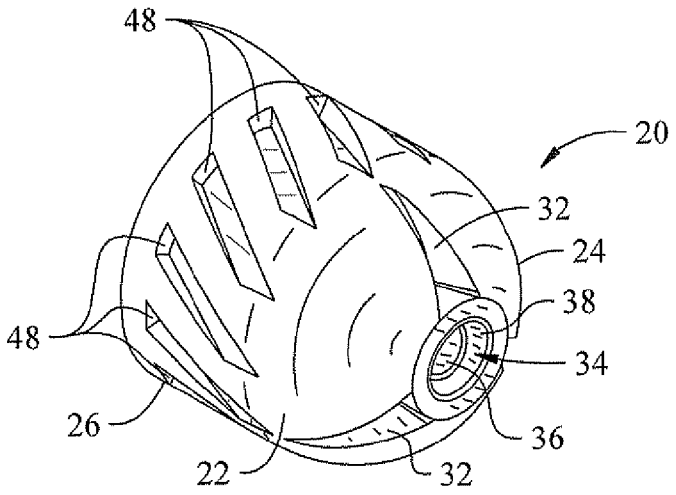
FIG. 1 is a perspective view of a first preferred embodiment of a slug constructed, according to the principles of this invention.
Figure 2:
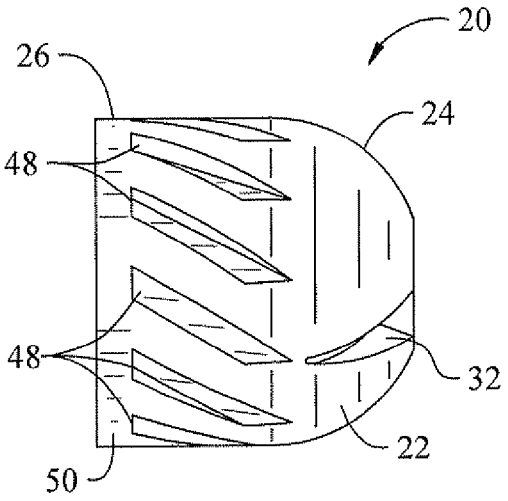
FIG. 2 is a left-side elevation view of the slug of the first embodiment.
Figure 3:
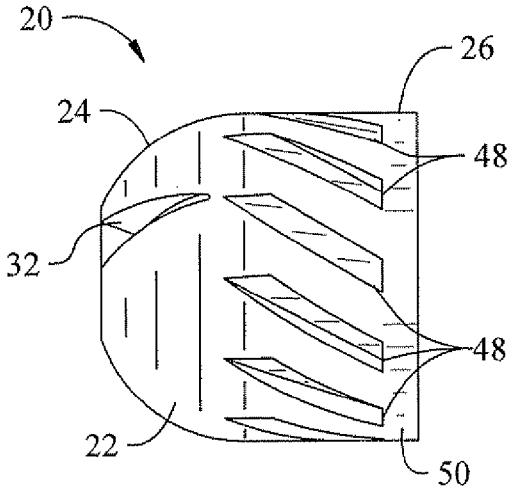
FIG. 3 is a right-side elevation view of the slug of the first embodiment.

Example embodiments will now be described more fully with reference to the accompanying drawings. A first preferred embodiment of a segmenting slug constructed according to the principles of this invention is indicated generally as 20 in FIGS. 1-9. The segmenting slug 20 of the first preferred embodiment is a Foster style slug, comprising a body 22 having a generally dome-shaped forward portion 24, a generally cylindrical rearward portion 26, and an opening 28 in the rear of the body forming an interior chamber 30. The slug 20 is preferably made of lead or a lead alloy, but the slug could be made of any sufficiently dense and malleable material.

Figure 5:
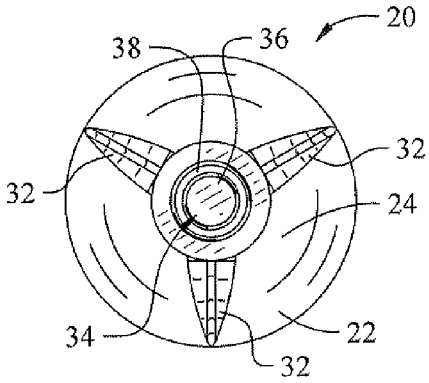
FIG. 5 is a front elevation view of the slug of the first embodiment.
Figure 6:
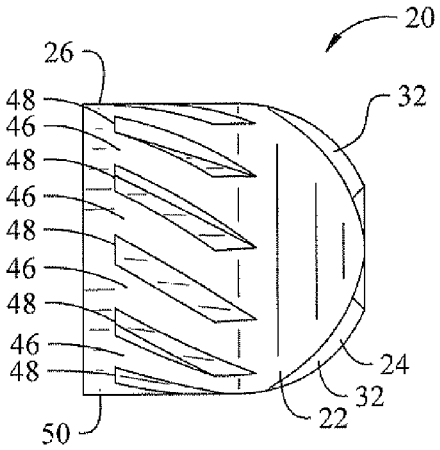
FIG. 6 is a bottom plan view of the slug of the first embodiment.
Figure 7:
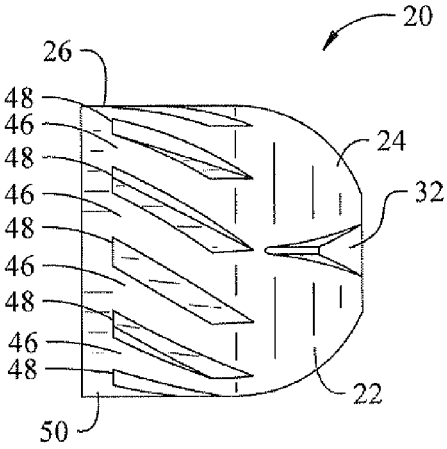
FIG. 7 is a top plan view of the slug of the first embodiment.
Figure 8:
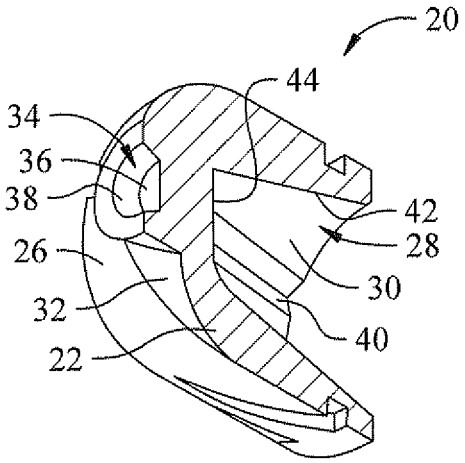
FIG. 8 is a perspective longitudinal cross sectional view of the slug of the first embodiment.
Figure 9:
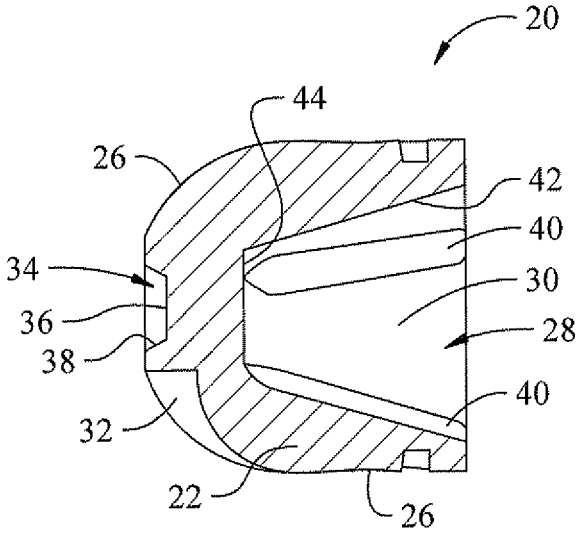
FIG. 9 is a vertical longitudinal cross sectional view of the slug of the first embodiment.
Figure 10:
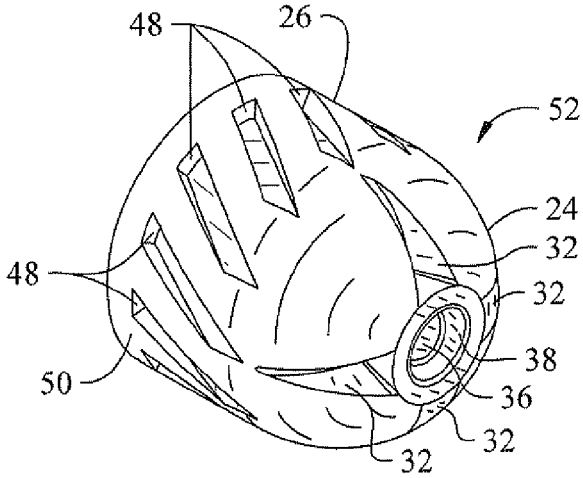
FIG. 10 is a perspective view of a second preferred embodiment of a slug constructed, according to the principles of this invention.
Figure 11:
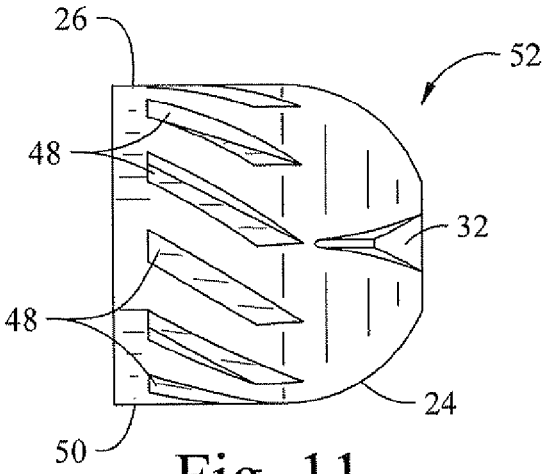
FIG. 11 is a left side elevation view of the slug of the second embodiment.
Figure 12:
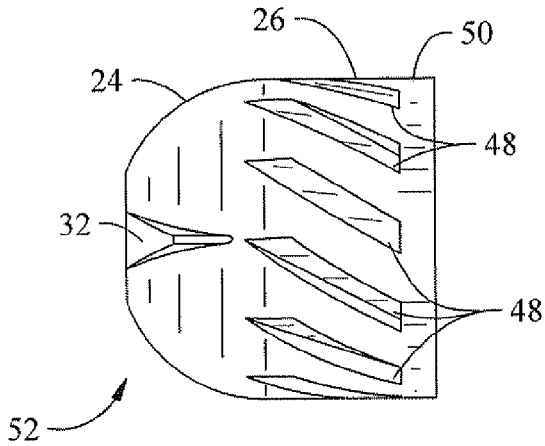
FIG. 12 is a right side elevation view of the slug of the second embodiment.
Figure 13:
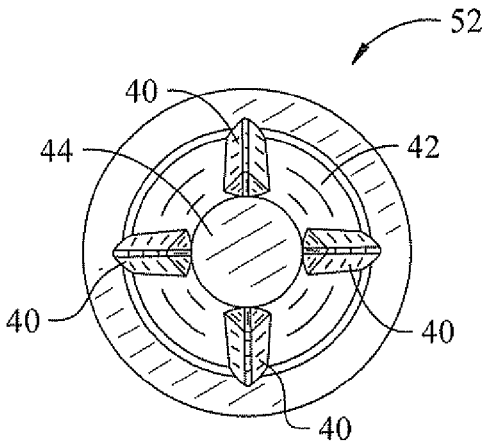
FIG. 13 is a rear elevation view of the slug of the second embodiment.
Figure 14:
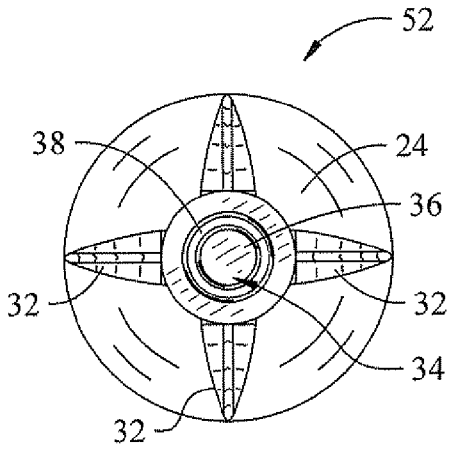
FIG. 14 is a front elevation view of the slug of the second embodiment.
Figure 15:
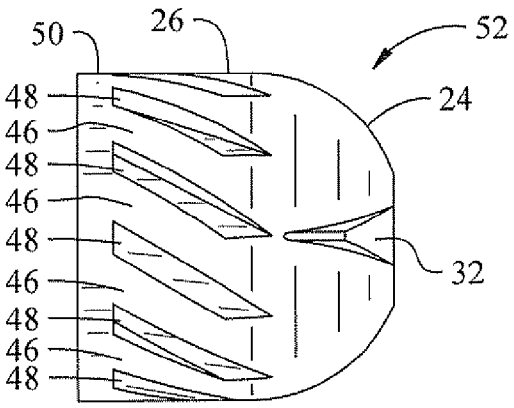
FIG. 15 is a bottom plan view of the slug of the second embodiment.
Figure 16:
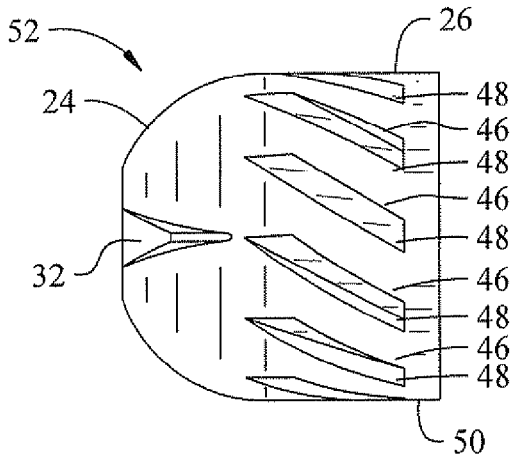
FIG. 16 is a top plan view of the slug of the second embodiment.
Figure 17:
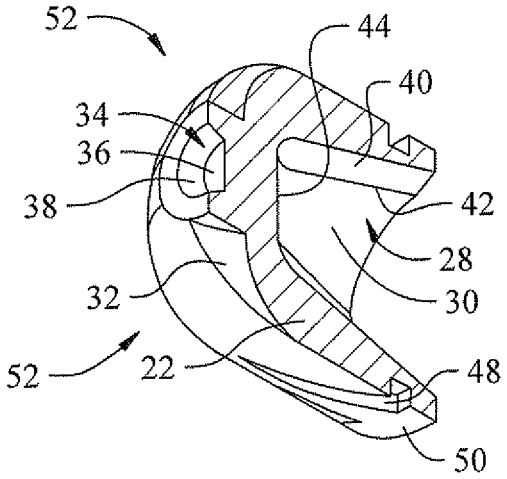
FIG. 17 is a perspective longitudinal cross sectional view of the slug of the second embodiment.
Figure 18:
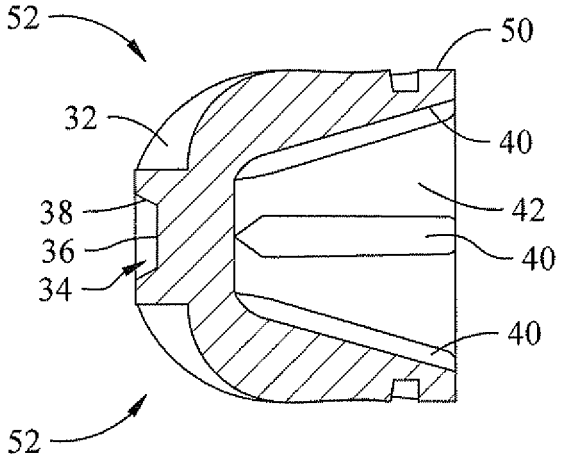
FIG. 18 is a vertical longitudinal cross sectional view of the slug of the second embodiment.

There are a plurality of generally radially extending notches 32 in the dome-shaped forward portion 24 of the slug 20. The notches 32 extend from near the center of the slug to the periphery. As shown in the Figures, the notches 32 have a generally v-shaped transverse profile. As a result of the dome shape of the forward portion 24, as shown in FIG. 5, the notches 32 appear wider near the center of the slug and narrower at the periphery of the slug. In this preferred embodiment, there are three notches 32, but there could be fewer or more notches, depending upon the number of segments desired. The notches 32 are preferably substantially equally spaced around the circumference of the slug.

As shown FIGS. 1-9, there is preferably a recess 34 in the center of the forward end of the slug. This recess 34 preferably has a flat bottom 36 and a frustoconical sidewall 38.

Figure 4:
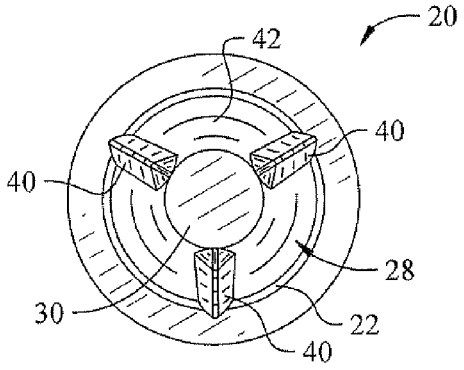
FIG. 4 is a rear elevation view of the slug of the first embodiment.

There are a plurality of generally longitudinally extending grooves 40 in the wall of the interior chamber 30. There is preferably one groove 40 for each notch 32. The grooves 40 preferably have a generally v-shaped transverse profile. The forward end of each groove 40, on the inside of the slug 20, is aligned with the radially outer end of each notch 32 on the exterior of the slug. As shown in FIG. 4, the interior chamber 30 of the slug 20 preferably has a tapering sidewall 42 and terminations in a generally flat bottom 44.

There are preferably a plurality of ribs or fins 46 on the rearward portion 26 of the slug 20 which are formed or defined by channels 48. These fins 46 and channels 48 are preferably oriented at an angle with respect to the longitudinal direction. Preferably the radially outer end of each notch 32 is aligned with one of the forward ends of one of the channels 48 on the exterior of the slug. A ring 50 is forward at the rearward end of the slug 20, and the fins 46 run into the ring 50, while the channels 48 terminate at the ring 50.

A second preferred embodiment of a slug constructed according to the principles of this invention, is indicated as 52 in FIGS. 10-18. Slug 52 is similar in construction to slug 20, and corresponding parts are identified with corresponding reference numerals. However, rather than the three notches 32 in slug 20 for causing the slug 20 to segment into three segments, the slug 52 has four notches 32, which causes the slug to segment into four segments.

The notches 32 and the grooves 40 are preferably configured so that the slug 20 or 52 can withstand the forces from being fired from a shotgun (whether in a sabot or not) without separating into segments, but can still separate into segments upon striking a target at muzzle velocities of 1400 fps or less, and in some cases as low as 1250 fps.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A segmenting slug comprising:

a body having a generally dome-shaped forward portion, a generally cylindrical rearward portion, and an opening in the rear of the body forming an interior chamber;

a plurality of generally radially extending notches in the dome-shaped forward portion of the slug, each of the notches having a generally v-shaped transverse profile, the width and depth of which decreases from its forward end toward its rearward end; and a longitudinally extending groove in the wall of the interior chamber aligned with each notch.

2. The segmenting slug according to claim 1 wherein there is a generally central recess in the forward end of the slug.

3. The segmenting slug according to claim 1 wherein the generally radially extending notches are substantially equally spaced around the circumference of the slug.

4. The segmenting slug according to claim 3 wherein there are three generally radially extending notches.

5. The segmenting slug according to claim 3 wherein there are four generally radially extending notches.

6. The segmenting slug according to claim 3 wherein each groove has a generally v-shaped transverse profile.

7. The segmenting slug according to claim 1 wherein there are a plurality of substantially parallel channels on the outside of the rearward section oriented at an angle with respect to the longitudinal direction.

8. The segmenting slug according to claim 7 wherein the radially outward end of each notch is aligned with one of the channels.

9. The segmenting slug according to claim 1 wherein the notches and the grooves are sufficiently deep that the slug does not separate into pieces upon firing from a shotgun.

10. The segmenting slug according to claim 9 wherein the notches and the grooves are configured so that the slug separates into segments when fired into 10% ballistic gelatin at 40 yards at a muzzle velocity of no more than 1400 feet per second.

11. The segmenting slug according to claim 9 wherein the notches and the grooves are configured so that the slug separates into segments when fired into 10% ballistic gelatin at 10 yards at a muzzle velocity of no more than 1250 feet per second.

12. The segmenting slug according to claim 9 wherein there is a generally central recess in the forward end of the slug.

13. The segmenting slug according to claim 12 wherein the generally radially extending notches are substantially equally spaced around the generally central recess in the forward end of the slug.

14. The segmenting slug according to claim 13 wherein there are three generally radially extending notches.

15. The segmenting slug according to claim 13 wherein there are four generally radially extending notches.

16. The segmenting slug according to claim 13 wherein each groove has a generally v-shaped transverse profile.

17. The segmenting slug according to claim 13 wherein there are a plurality of substantially parallel channels on the outside of the rearward section oriented at an angle with respect to the longitudinal direction.

18. The segmenting slug according to claim 17 wherein the radially outward end of each notch is aligned with one of the channels.

* * * * *